US006997639B2

(12) United States Patent
Nadasde

(10) Patent No.: US 6,997,639 B2
(45) Date of Patent: Feb. 14, 2006

(54) METHOD AND APPARATUS FOR ADJUSTING THE HEIGHT AND INCLINATION OF ROADWAY AND GREENWAY APPURTENANCES

(76) Inventor: Wayne John Nadasde, 715 Richards Road, Kelowna (CA) V1X 2X5

( * ) Notice: Subject to any disclaimer, the term of this patent is extended or adjusted under 35 U.S.C. 154(b) by 0 days.

(21) Appl. No.: 10/973,275

(22) Filed: Oct. 27, 2004

(65) Prior Publication Data

US 2005/0058505 A1 Mar. 17, 2005

Related U.S. Application Data

(63) Continuation-in-part of application No. 10/679,418, filed on Oct. 7, 2003, now Pat. No. 6,811,350.

(60) Provisional application No. 60/416,248, filed on Oct. 7, 2002, provisional application No. 60/456,213, filed on Mar. 21, 2003.

(51) Int. Cl.
*E02D 29/14* (2006.01)

(52) U.S. Cl. ..... 404/26; 52/20

(58) Field of Classification Search ..... 404/25, 404/26; 52/19, 20
See application file for complete search history.

(56) References Cited

U.S. PATENT DOCUMENTS

| | | | | | |
|---|---|---|---|---|---|
| 1,076,386 | A | * | 10/1913 | O'Day | 404/26 |
| 2,930,295 | A | * | 3/1960 | Hale | 404/26 |
| 3,263,579 | A | * | 8/1966 | Dorris | 404/26 |
| 3,392,640 | A | * | 7/1968 | Zeile, Jr. | 404/26 |
| 3,773,428 | A | * | 11/1973 | Bowman | 404/26 |
| 3,858,998 | A | * | 1/1975 | Larsson et al. | 404/26 |
| 3,930,739 | A | * | 1/1976 | Larsson et al. | 404/26 |
| 4,038,789 | A | * | 8/1977 | Axgarde et al. | 52/20 |
| 4,273,467 | A | * | 6/1981 | Cronk | 404/26 |
| 4,618,464 | A | * | 10/1986 | Ditcher | 264/35 |
| 4,925,337 | A | * | 5/1990 | Spiess et al. | 404/26 |
| 4,976,568 | A | * | 12/1990 | Hess | 404/26 |
| 5,205,668 | A | * | 4/1993 | Adams | 404/26 |
| 5,344,253 | A | * | 9/1994 | Sacchetti | 404/26 |

(Continued)

FOREIGN PATENT DOCUMENTS

BE 1009225 A * 1/1997

(Continued)

*Primary Examiner*—Thomas B. Will
*Assistant Examiner*—Alexandra Pechhold
(74) *Attorney, Agent, or Firm*—Anthony C. Edwards

(57) ABSTRACT

An apparatus for adjusting the height and inclination of roadway and greenway appurtenances includes a rigid annular support ring mountable onto a rigid annular spacer ring sized so as to be mountable onto a manhole and a manhole frame mountable onto the support ring. The manhole frame is substantially frusto-conically shaped. A rigid annular base flange may be mounted around a base end of the manhole frame. A plurality of threaded bores are formed in spaced array around the base flange. Rigid elongate threaded members are threadably mountable into the threaded bores so as to be selectively threadably adjustable in the threaded bores and so as to protrude downwardly from the base flange into engagement, beneath the manhole frame, with a top surface of the support ring when the manhole frame is mounted on the support ring. The threaded members are threadably adjustable in the threaded bores to elevate or to tilt the manhole frame relative to the support ring.

20 Claims, 11 Drawing Sheets

U.S. PATENT DOCUMENTS 5,628,152 A * 5/1997 Bowman ..... 52/20
5,941,025 A * 8/1999 Chang ..... 52/20
5,974,741 A * 11/1999 Fukuhara ..... 52/20
6,007,270 A * 12/1999 Bowman ..... 404/25
6,161,985 A * 12/2000 Hinkle et al. ..... 404/26
6,179,518 B1 * 1/2001 Suatac ..... 404/26
6,371,687 B1 * 4/2002 Heintz et al. ..... 404/26
6,435,764 B1 * 8/2002 McNeely ..... 404/26
6,524,026 B1 * 2/2003 Sondrup ..... 404/26
6,811,350 B1 * 11/2004 Nadasde ..... 404/26

FOREIGN PATENT DOCUMENTS

DE 3016401 A * 2/1981

* cited by examiner

METHOD AND APPARATUS FOR ADJUSTING THE HEIGHT AND INCLINATION OF ROADWAY AND GREENWAY APPURTENANCES

CROSS REFERENCE TO RELATED APPLICATION

This application is a Continuation-in-Part of U.S. Pat. application Ser. No. 10/679,418 filed Oct. 7, 2003, now U.S. Pat. No. 6,811,350, which claims priority from U.S. Provisional Patent Application No. 60/416,248 filed Oct. 7, 2002 and U.S. Provisional Patent Application No. 60/456,213 filed Mar. 21, 2003 entitled Method and Apparatus for Adjusting the Height and Inclination of Roadway and Greenway Appurtenances.

FIELD OF THE INVENTION

This invention relates to the field of devices for adjusting the elevation of manhole covers, catch basin frames or other appurtenances relative to a roadway or greenway surface or the like, and in particular to the use of set screws for adjusting the angular relation of manhole frame or other appurtenances in relation to a concrete substrate such as supports mounted atop a conventional manhole.

BACKGROUND OF THE INVENTION

Many municipalities may now enforce quite close tolerances in road construction that require the installed manhole frame once mounted onto the annular concrete manhole spacer ring, to be substantially flush with the roadway surface, that is, the surface of the asphalt. For example, in applicant's experience, at least one municipality requires that the manhole frame be parallel to the asphalt surface and offset from the asphalt surface no more than seven millimetres.

Because the manhole apertures themselves are horizontal, and often the road grade is not horizontal, for example having a grade of up to four percent, or in extreme cases a twelve percent grade and/or a seven percent crossfall, it is conventional that, firstly, an annular concrete spacer ring, sometimes referred to as a "donut" or a "riser", is installed onto the manhole aperture, and then a manhole frame is mounted on top of the concrete spacer ring. Because the manhole frame is very heavy, being constructed of solid metal such as grey or ductile iron, it is often a two-man lift to set the manhole frame onto the concrete spacer ring and then a two-man job to adjust the tilt or incline of the manhole frame on top of the concrete spacer ring. Typically what is done is one man lifts one side or edge of the manhole frame while the second man inserts makeshift shims, including whatever small pieces of wood or rocks may be at hand, so as to adjust the angular relation of the manhole frame onto the horizontal upper surface of the concrete spacer ring. In this fashion, the manhole frame is adjusted both vertically and tilted relative to the concrete spacer ring so as to bring the upper surface of the manhole frame within the specified tolerances of the anticipated upper surface of the asphalt.

Once a manhole frame has been so adjusted, the roadway construction continues around the manhole frame, for example, as the crush is compacted. This may result in the manhole frame being disturbed before the concrete spacer ring and manhole frame are encased in concrete so as to leave the manhole frame out of adjustment because of disruption to the shims. This then means that the manhole frame must again be adjusted either before or after the asphalt is laid. Thus, as may be seen, the prior art method of adjusting the manhole frame is both labour intensive and prone to later misalignment requiring the adjustment work to be redone.

Therefore there exists a need in the prior art for a simple to install, easily adjustable mechanism for adjusting the vertical height of a manhole frame above the concrete spacer ring and for adjusting the angular inclination of the manhole frame relative to the concrete spacer ring.

SUMMARY OF THE INVENTION

The present invention is an apparatus for adjusting the height above, and angular relation of a roadway or greenway appurtenance such as a manhole frame relative to a substrate such as an annular concrete spacer ring for mounting atop a manhole aperture. The use of set screws which are threaded through the manhole frame to engage a support ring mounted on to of the annular concrete spacer ring inhibits lateral movement of the manhole frame relative to the concrete spacer ring and the annular support ring.

The present invention includes a rigid annular support ring sized so as to be mountable onto a concrete spacer ring in mating engagement, and a manhole frame mountable onto the support ring so as to sandwich the support ring between the manhole frame and the concrete spacer ring. An annular base flange is mounted around the base end of the manhole frame. In an embodiment of the invention, the manhole frame is frusto-conically shaped or it may be cylindrical or rectangular or any other shape in plan form having a diameter corresponding to the diameter of the annular support ring. A plurality of threaded bores are formed in spaced array around the base flange. The plurality of threaded bores may be at least three threaded bores in substantially equally radially spaced array around the base flange. Rigid elongate threaded members are threadably mountable into the threaded bores so as to be selectively threadably adjustable in the threaded bores and so as to protrude downwardly from the base flange into frictional engagement, beneath the manhole frame, with a top surface of the support ring when the manhole frame is mounted on the support ring. The threaded members are threadably adjustable in the threaded bores to elevate or to tilt the manhole frame relative to the support ring and the concrete spacer ring.

The manhole frame may include a vertical annular collar mounted around the inner surface of the manhole frame, the vertical annular collar extending downwards towards an inner surface of the annular support ring so as to space and center the manhole frame relative to the support ring when the manhole frame is mounted onto the support ring. The support ring may include an array of equally radially spaced apart flanges mounted so as to extend outwardly from the support ring for engaging the top surface of the concrete spacer ring when the support ring is mounted thereon, the array of flanges aligning directly under the threaded bores when the manhole frame is mounted on the support ring. The support ring may have a lower rim mounted to an inner circumference of the support ring for mating inside the spacer ring. The support ring may also have an outer rim mounted so as to extend upwardly from an outer surface of at least one of the array of flanges such that when the manhole frame is mounted on the support ring, the outer rim encompasses the base flange mounted on the manhole frame so as to prevent any movement of the manhole frame relative to the support ring.

Retaining means may be mounted on at least three of the array of flanges. The retaining means may be a sleeve or a nut or any other receiving member for mating engagement with the lowermost ends of the threaded members. In an embodiment of the invention, the retaining means is a corresponding groove defined by a top surface of each of the array of flanges, the lowermost ends of the threaded members mating substantially conformably with the groove. Preferably, the lowermost ends of the threaded members are not concave. For example, advantageously the lowermost ends of the threaded members are bullet-shaped and mate with the corresponding groove so as to conform to the shape of the lowermost ends. Preferably, the threaded members are set screws made of a high strength alloy steel composition that is non-reactive with the manhole frame such that excessive rusting or seizing of the set screws are avoided.

In an alternative embodiment, the support ring may include an annular flange mounted so as to extend outwardly from the support ring for engaging the top surface of the concrete spacer ring when the support ring is mounted thereon and for alignment under the threaded bores when the manhole frame is mounted on the support ring. The support ring may have a lower rim mounted to an inner circumference of the support ring for mating inside the concrete spacer ring. The support ring may also have an outer annular rim mounted so as to extend upwardly from an outer circumference of the annular flange such that when the manhole frame is mounted on the support ring, the annular outer rim encompasses the base flange mounted on the manhole frame so as to prevent any movement of the manhole frame relative to the support ring.

Retaining means may be mounted on the annular flange for mating with lowermost ends of the threaded members. The retaining means may be a sleeve or a nut or any other receiving member for mating engagement with the lowermost ends of the threaded members. In the embodiment of the invention, the retaining means is an annular groove defined by a top surface of the annular flange, the lowermost ends of the threaded members mating substantially conformably with the annular groove. Preferably, the lowermost ends of the threaded members are not concave and are bullet-shaped for mating with the corresponding groove. Preferably, the threaded members are set screws made of a high strength alloy steel composition that is non-reactive with the manhole frame such that excessive rusting or seizing of the set screws are avoided.

Each of the set screws may be adjusted in relation to the base flange so that the upper surface of the manhole frame is brought into parallel, substantially flush, relation with the upper surface of the roadway being built.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EMBODIMENTS OF THE INVENTION

Figure 1:
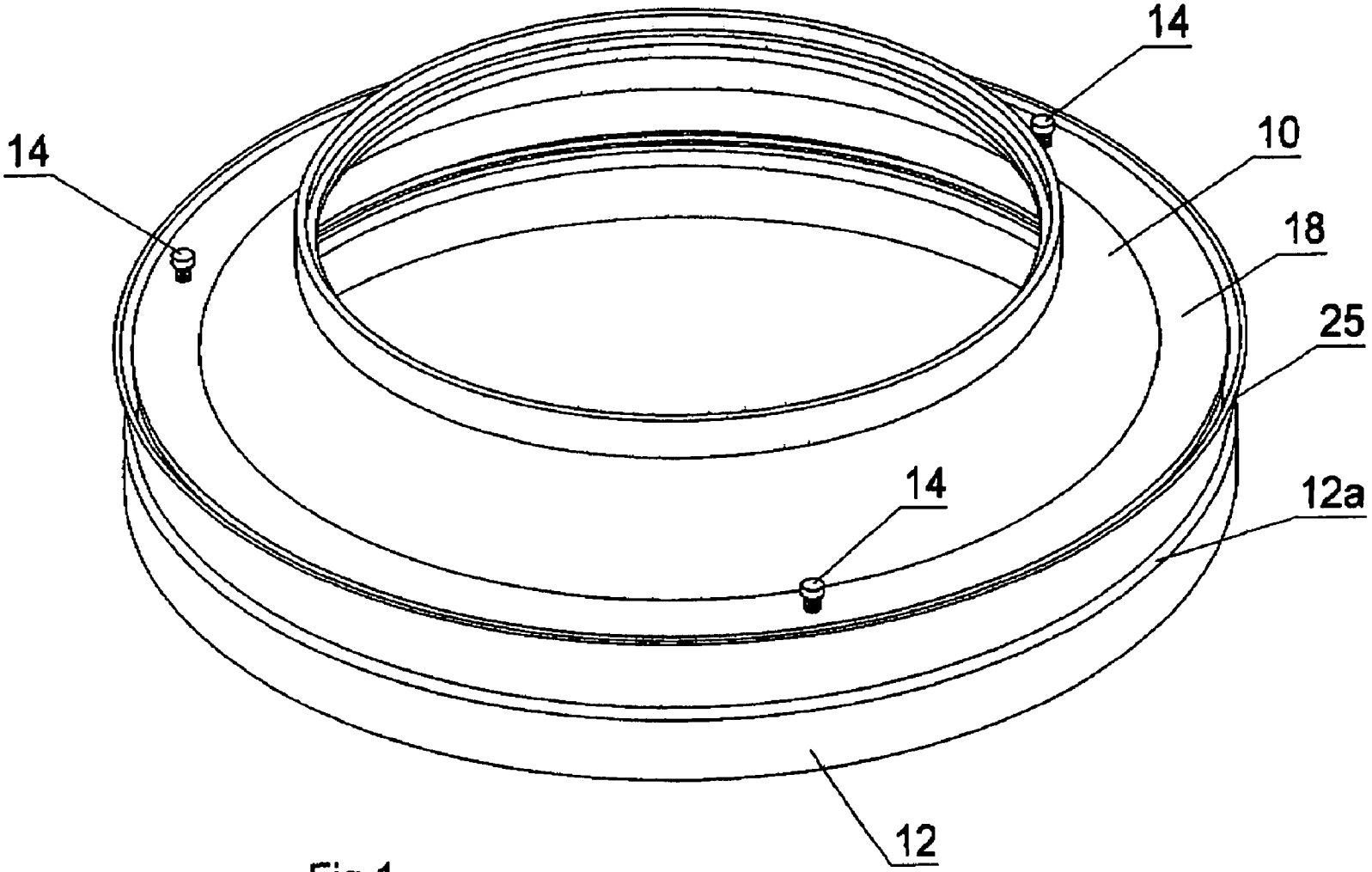
FIG. 1 is, in perspective view, an embodiment of a manhole frame mounted atop a concrete spacer ring wherein a support ring is sandwiched between the manhole frame and the spacer ring.
Figure 2:
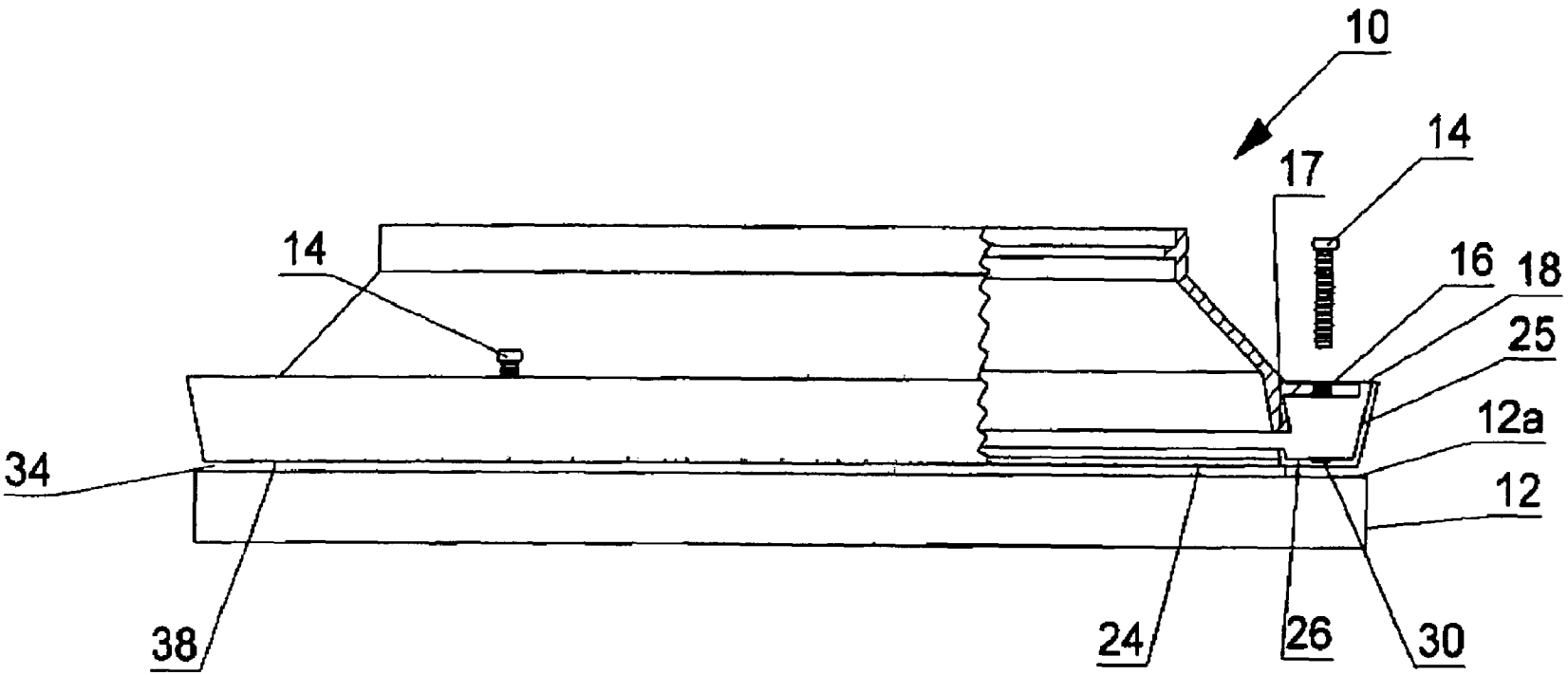
FIG. 2 is, in partially cut away, partially exploded side elevation view, the manhole frame, the support ring, and the spacer ring of FIG. 1.
Figure 3:
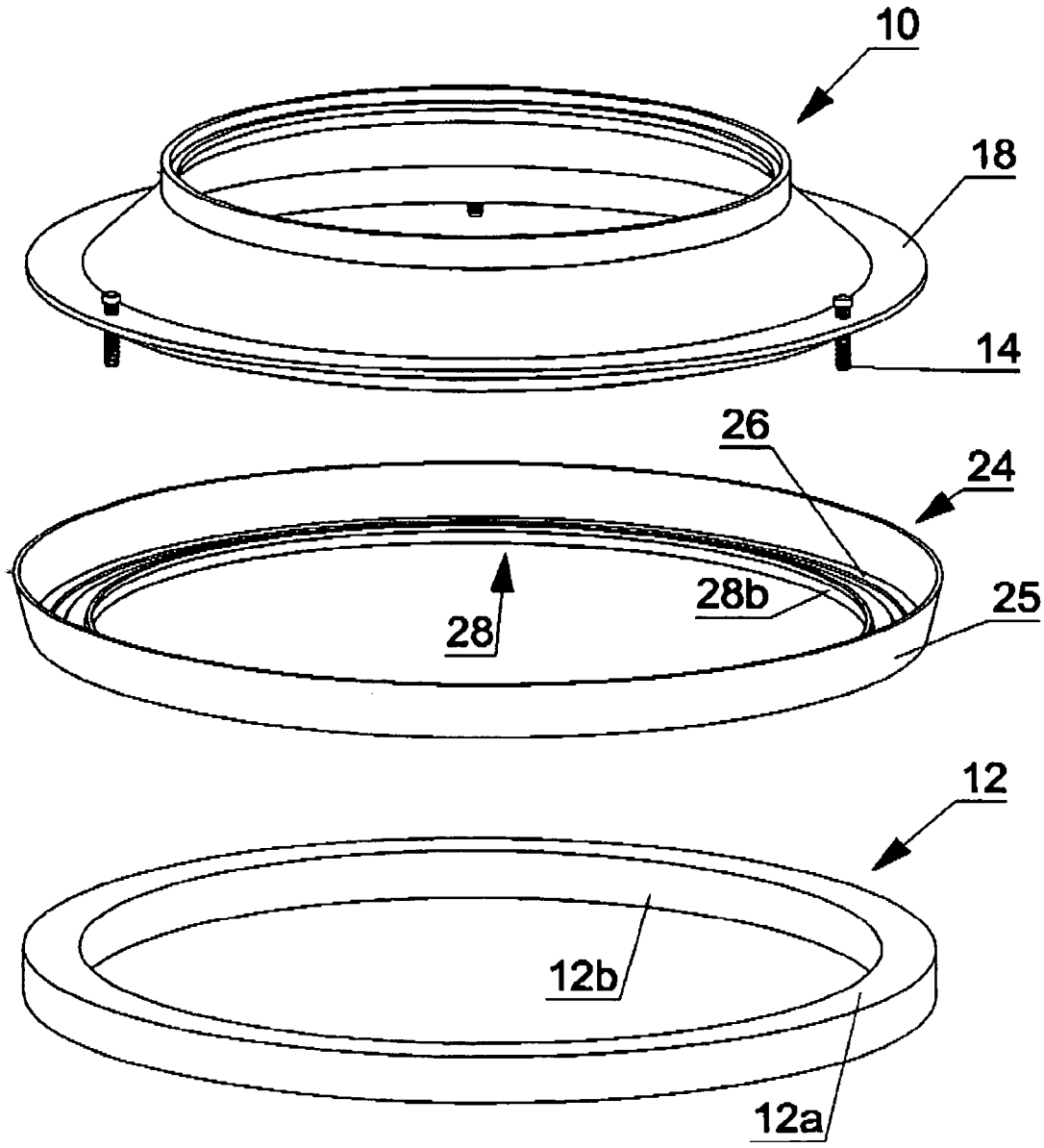
FIG. 3 is, in exploded perspective view, the manhole frame, the support ring, and the spacer ring of FIG. 1.

In what follows, reference is made to drawings wherein similar characters of reference denote corresponding parts in each view. Thus as seen in FIGS. 1 and 2, manhole frame 10 is adjustably mounted atop support ring 24 which is mounted atop annular concrete spacer ring 12 by the threading of threaded set screws 14 through threaded vertical bores 16 in the base flange 18 of manhole frame 10. Reference herein to use of set screws 14 is also intended to the alternative use of other elongate members, one advantage of the use of set screws being however that they may be screwed down into the bores 16 until their ends are entirely within the bores thereby allowing an extra, albeit small, range of travel. In one embodiment not intended to be limiting, a plurality of at least two, and preferably three or more set screws 14 are threadably mounted through corresponding vertical bores 16 for example in equally radially spaced array equi-distant apart around base flange 18.

In an embodiment of the present invention not intended to be limiting, set screws 14 are made of steel having a composition that at least meets the minimum specification for water main fittings as recommended by the American Water Works Association (AWWA), the specification namely core "ten", high strength alloy steel, ASTM 654512 and ANSI-AWWA-C111-A21.11. Such composition of steel will not cause set screws 14 to rust through or seize within the threaded bores 16 as the metal chemistry between manhole frame 10, which is typically made of cast iron, and set screws 14 do not react and cause excessive rust or seizing at the threads. Furthermore, the preferred steel composition reduces deterioration caused by corrosive soils. In an alternative embodiment, set screws 14 may be made of high density polyethylene, ultra high molecular weight polyethylene, or any high strength materials.

Although manhole frame 10 is preferably frusto-conically shaped, this is not intended to be limiting as manhole frame 10 may be any shape so long as the top of manhole frame 10 may be adjusted to be flush with the pavement 36 for proper assembly and installation underneath the roadway and the bottom end of manhole frame 10 may be positionable on top of annular support ring 24. For example, manhole frame 10 may be cylindrically shaped or rectangular shaped, having an annular collar mounted to the inner surface of the base such that the rectangular manhole frame may be positioned on top of support ring 24.

A support ring 24 is provided for mounting between manhole frame 10 and spacer ring 12. In an embodiment of the invention, support ring 24 has a horizontal annular flange 26 for seating down onto the upper surface 12*a* of spacer 12, and a vertical collar 28*b* mounted around the inner circumference of support ring 24, sized for snug seating within the annular inner surface 12*b* of spacer ring 12. Annular flange 26 and support ring 24 provides support to spacer ring 12 such tat the weight of manhole frame 10 and the force of set screws 14 do not cause spacer ring 12 to crack or be crushed. Support ring 24 also assists in the positioning and maintenance of manhole frame 10 on top of spacer 12 such that manhole frame 10 is centered with respect to manhole 32. A lower rim 28*b* of collar 28 extends vertically downwards from the inner circumference of support ring 24 to snugly mate up against inner surface 12*b* of spacer ring 12 to center support ring 24 on to of spacer ring 12, thereby assisting in centering manhole frame 10 relative to spacer ring 12.

Figure 4:
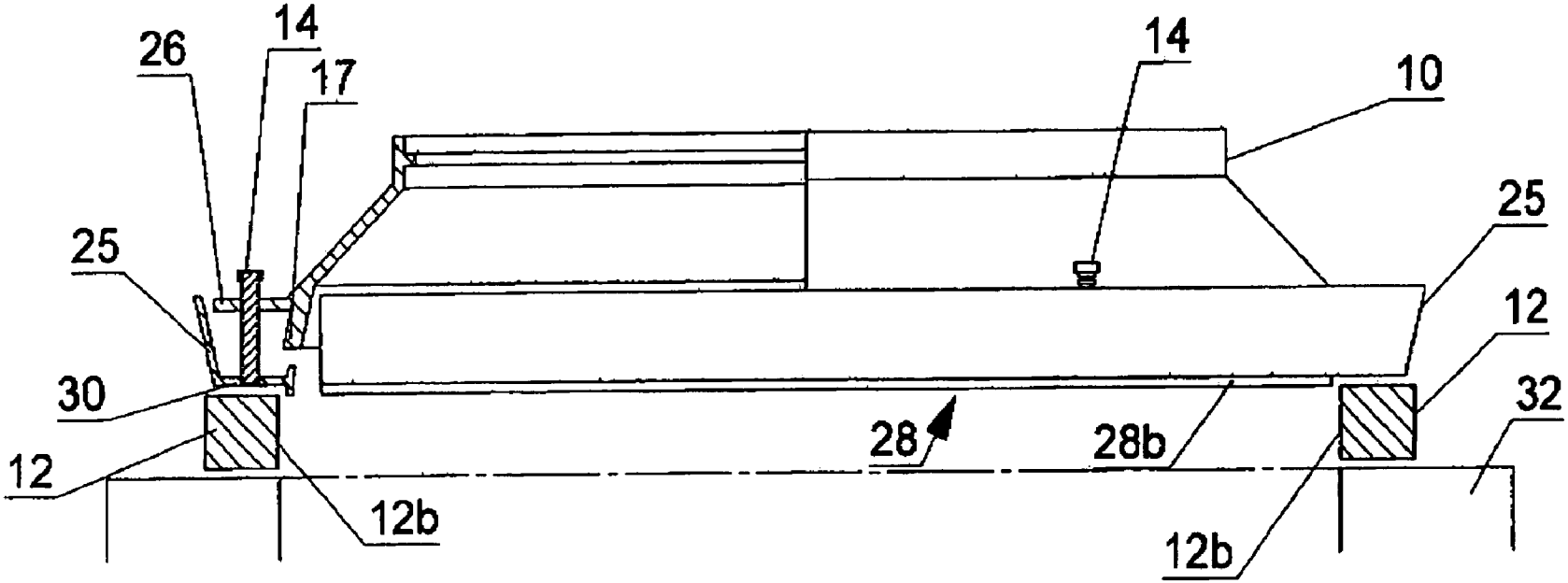
FIG. 4 is, in partially cutaway exploded view, the embodiment of FIG. 1.
Figure 4A:
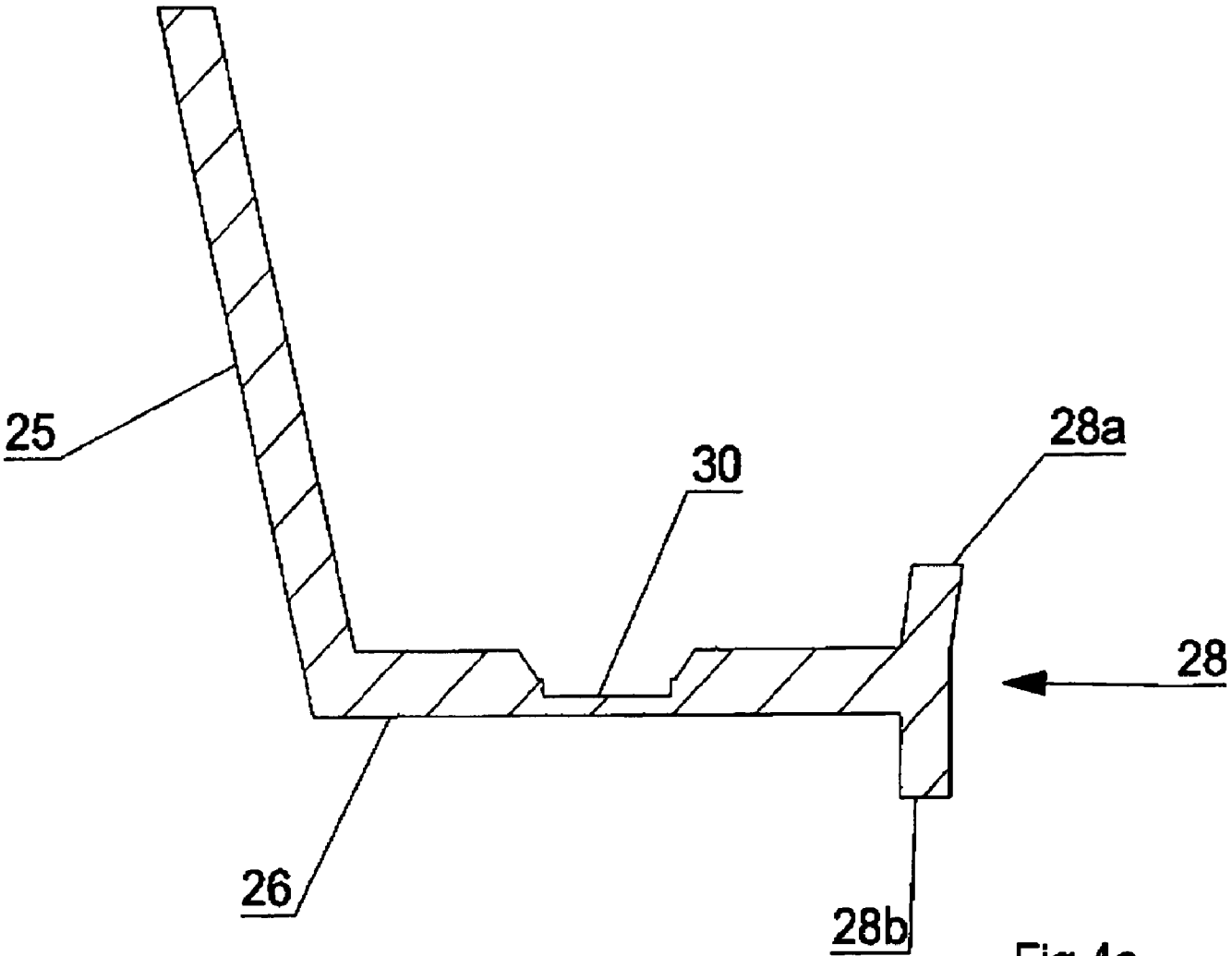
FIG. 4*a* is an enlarged view of a portion of FIG. 4.
Figure 5:
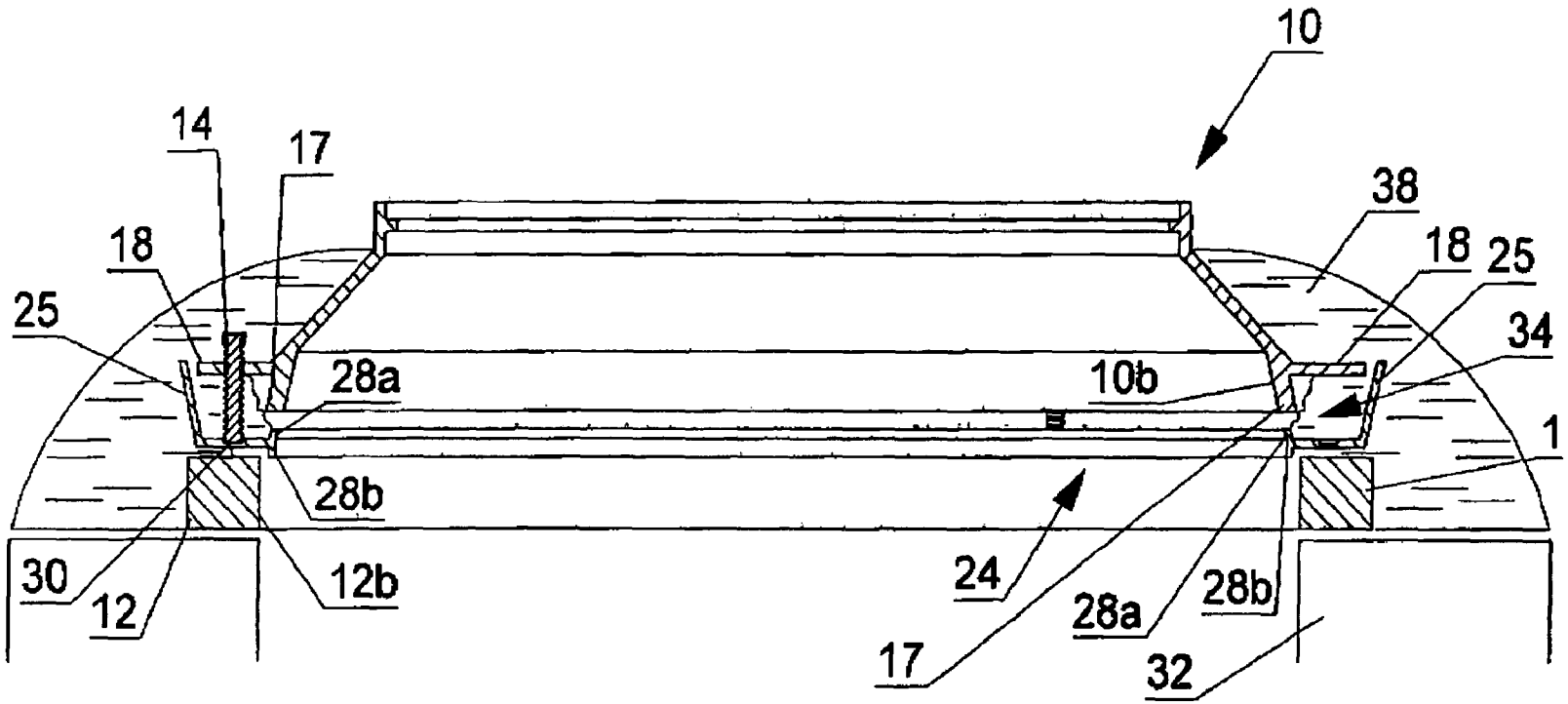
FIG. 5 is a cross section through the assembled and installed manhole frame of FIG. 4.
Figure 6:
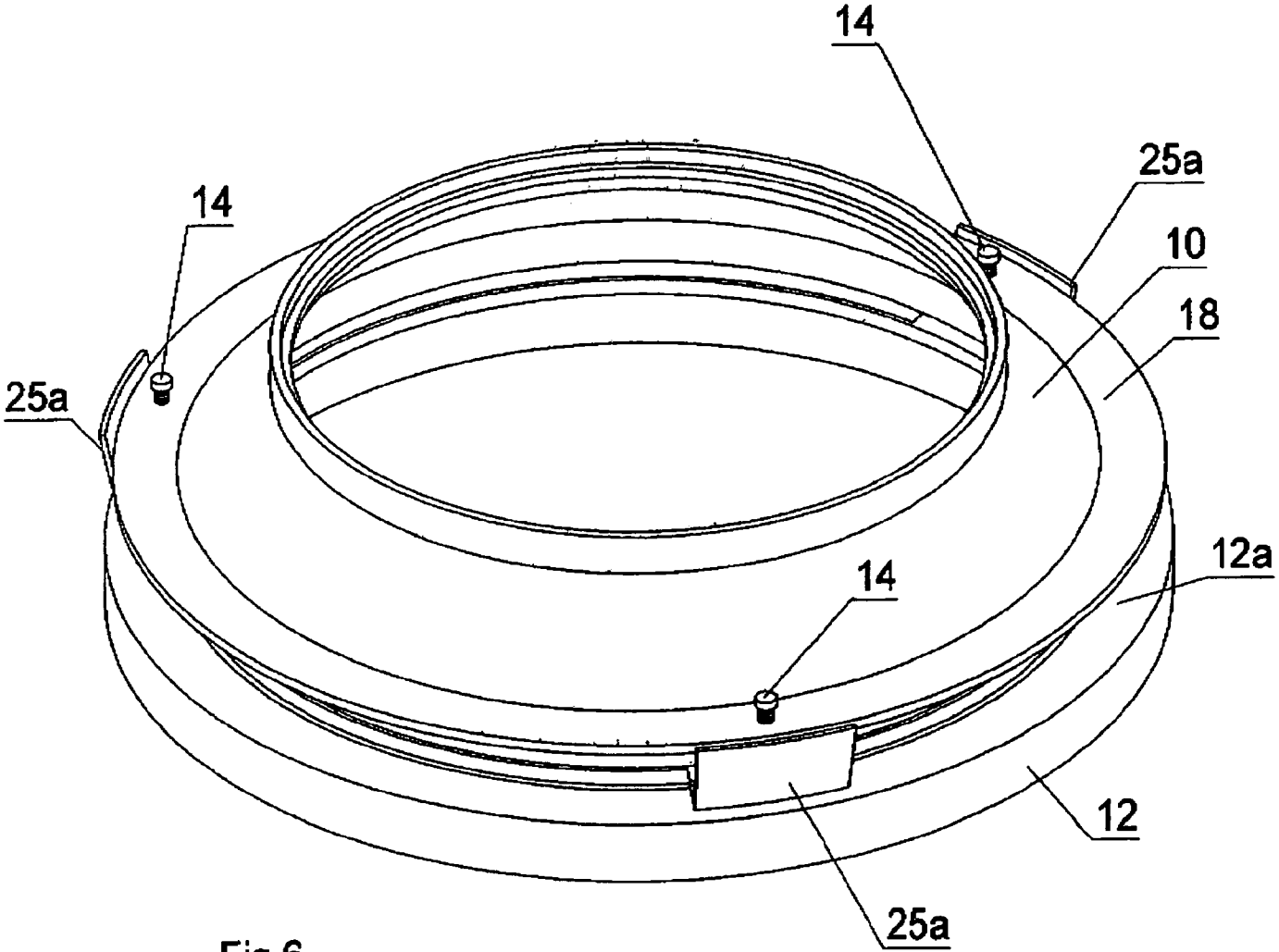
FIG. 6 is in perspective view, an alternative embodiment of a manhole frame mounted atop a concrete spacer ring wherein a support ring is sandwiched between the manhole frame and the spacer ring.
Figure 7:
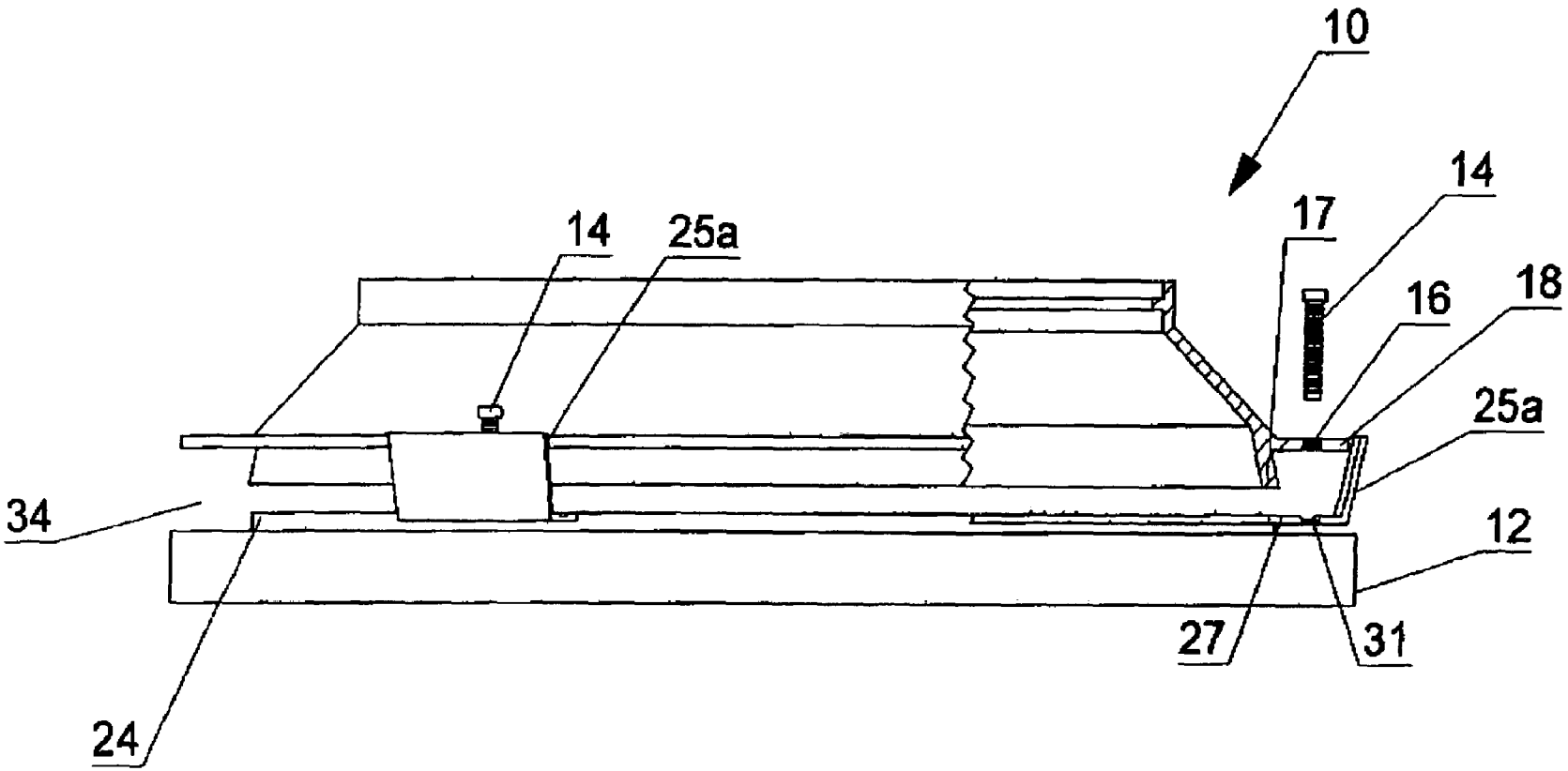
FIG. 7 is, in partially cut away, partially exploded side elevation view, the manhole frame, the support ring, and the spacer ring of FIG. 6.
Figure 8:
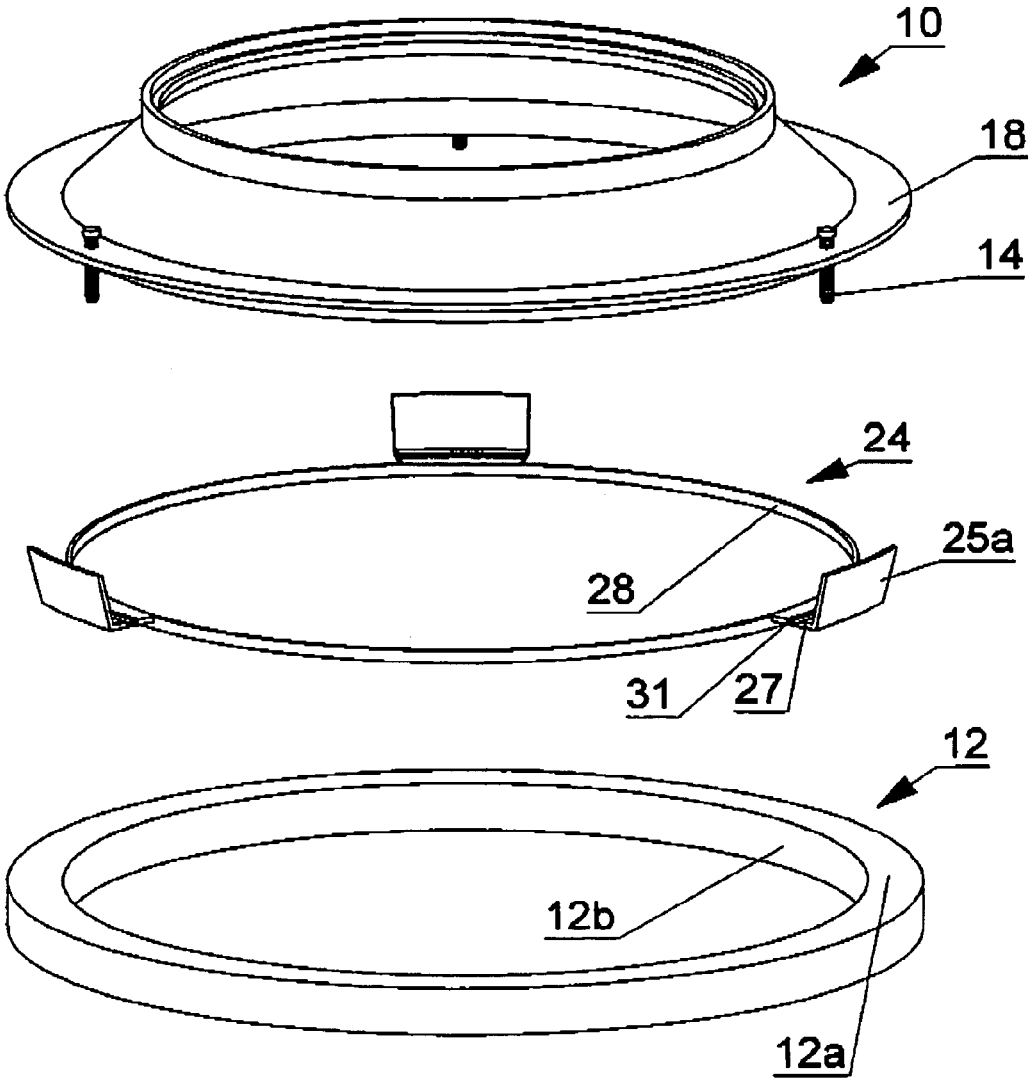
FIG. 8 is, in exploded perspective view, the manhole frame, the support ring, and the spacer ring of FIG. 6.
Figure 9:
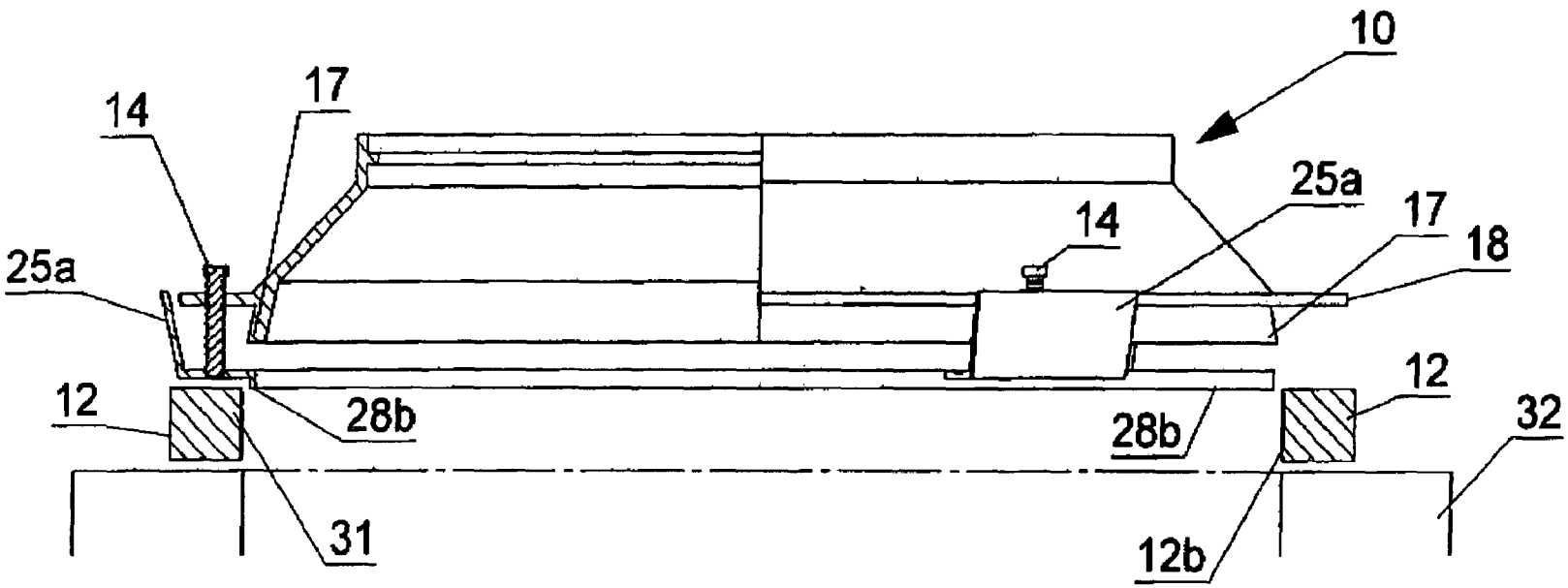
FIG. 9 is, in partially cutaway exploded view, the embodiment of FIG. 6.
Figure 10:
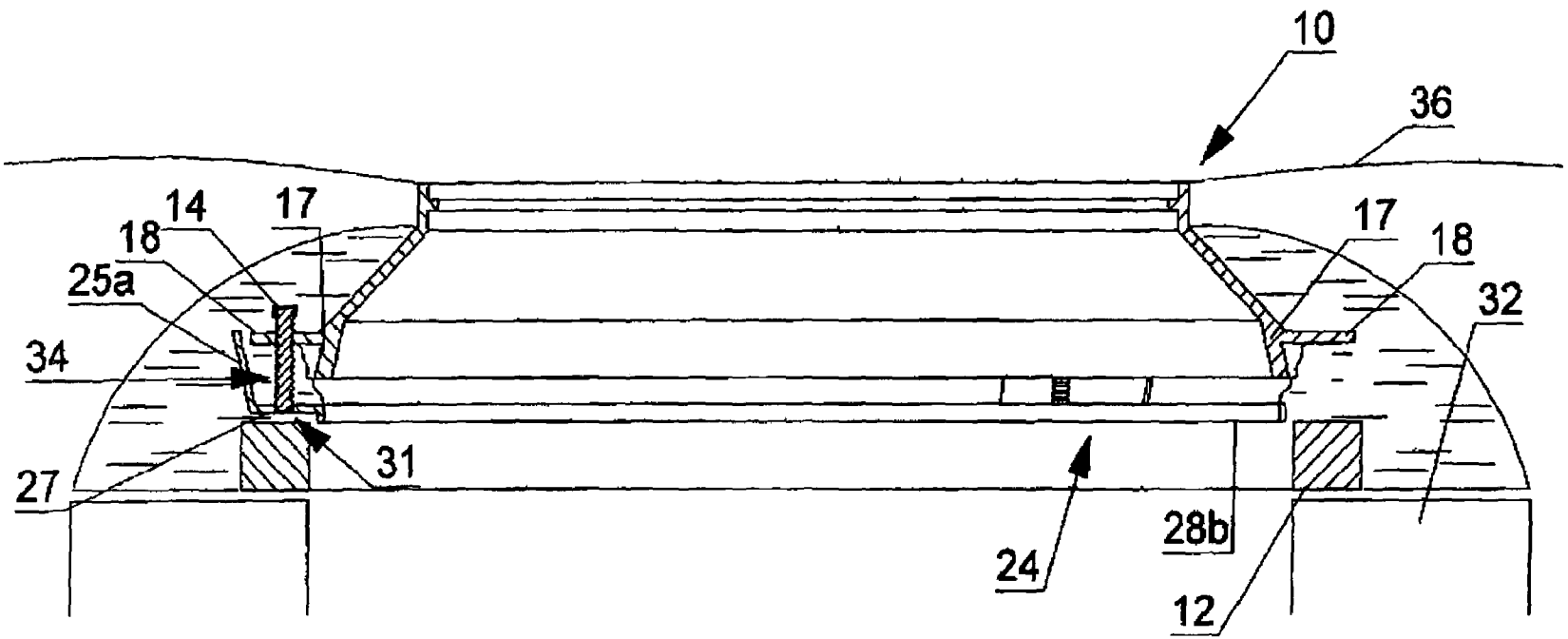
FIG. 10 is cross section through the assembled and installed manhole frame of FIG. 6.

Collar 28 may also extend vertically upwards from the inner circumference of support ring 24 towards the inner surface 10*b* of manhole frame 10. In particular, upstanding rim portion 28*a* of collar 28 as better seen in FIG. 4*a* is sized so as to maintain the concrete 38 inserted into the space 34 between manhole frame 10 and support ring 24. The insertion of concrete 38 in space 34 provides structural strength and stability while maintaining the position of support ring 24 and manhole frame 10 over spacer ring 12. Preferably, upper rim 28*a* flares outwards from annular flange 26 as seen in FIG. 4*a* so as to better serve to inhibit concrete 38 from being forced beyond space 34 and extending into or falling into the manhole opening. Furthermore, upper rim 2*a* assists in centering manhole frame 10 onto support ring 24 by assisting in catching the lower ends of set screws 14 within the annular channel formed between upper rim 28*a* and outer rim 25, thereby centering manhole frame 10 relative to spacer ring 12.

Alternatively, as seen in FIGS. 7–10, a vertical annular collar 17 mounted around the inner surface of manhole frame 10 may be provided to maintain the appropriate minimum distance between manhole frame 10 and support ring 24. More particularly, instead of upstanding rim portion 28*a* extending vertically upwards from the inner circumference of support ring 24 towards inner surface 10*b* of manhole frame 10, vertical collar 17 extends vertically downwards from base flange 18 of manhole frame 10 towards the inner circumference of support ring 24, thereby providing the same function as upper rim 28*a*. Preferably, vertical collar 17 also flares outwards towards base annular flange 26 and base flange 18 so as to inhibit concrete 38 from being forced into the manhole opening.

Thus, with lower rim 28*b* of collar 28 seated within inner surface 12*b*, manhole frame 10 may be lowered down onto support ring 24 whereupon upper rim 28*a* assists in centering manhole frame 10 onto support ring 24 so as to bring the lower ends 14*a* of set screws 14 into mating engagement within a correspondingly sized annular groove 30 formed on the upper surface 26*a* of annular flange 26. In the alternative embodiment where vertical collar 17 mounted around the inner surface of manhole frame 10 is provided instead of upper rim 28*a*, manhole frame 10 may be similarly lowered down onto support ring 24 whereupon vertical collar assists in centering manhole frame 10 onto support ring 24 so as to bring the lower ends 14*a* of set screws 14 into mating engagement within a correspondingly sized annular groove 30 formed in the upper surface 26*a* of annular flange 26. In both embodiments, the lower ends 14*a* of set screws 14 may have blunt squared-off ends or bullet-shaped ends for snug mating into annular groove 30 such that lower ends 14*a* do not cut into the surface of annular groove 30. If the ends of the set screws do not bite into annular groove 30, for example as would happen with point-ended set screws, the possibility of the manhole frame 10 "walking out" of its preferred orientation as the set screws are turned is minimized. Alternatively, retaining means such as sleeves, collars, or nuts for threadably receiving or anchoring the lower ends of the set screws set screws 14 may be mounted on upper surface 26*a* of annular flange 26 to correspondingly mate with lower ends of set screws 14.

Movement of manhole frame 10 relative to spacer ring 12 once manhole frame 10 has been installed is thereby inhibited so as to increase the likelihood of maintaining the correct vertical alignment of manhole frame 10 over manhole 32 up until and during the pouring of concrete around manhole frame 10 and spacer ring 12. In an embodiment of the present invention, outer annular rim 25 extends upwardly and outwardly from the outer circumference of annular flange 26 such that when manhole frame 10 is lowered onto support ring 24, outer annular rim 25 surrounds or encompasses the outer circumference of base flange 18 to further prevent any movement of manhole frame 10 relative to spacer ring 12 so as to maintain the position of manhole frame 10 over manhole 32. Alternatively, outer annular rim 25 may extend downwardly from the outer circumference of annular flange 26 such that when support ring 24 is mounted on spacer ring 12, outer annular rim 25 may assist in centering and maintaining the position of support ring 24 on spacer ring 12.

In another embodiment of the present invention, support ring 24 may have an array of equally radially spaced apart horizontal flanges 27 corresponding to the position of vertical bores 16 for seating down onto upper surface 12*a* of spacer 12 instead of having a horizontal annular flange 26. A lower rim 28*b* of collar 28 extends vertically downwards from the inner circumference of support ring 24 to snugly mate up against inner surface 12*b* of spacer ring 12 to center support ring 24 on top of spacer ring 12, thereby assisting in centering manhole frame 10 relative to spacer ring 12. Collar 28 also extends vertically upwards from the inner circumference of support ring 24 towards inner surface 10*b* of manhole frame 10 so as to maintain the elevation of manhole frame 10 at an appropriate distance above support ring 24 to thereby improve the consistent insertion of the concrete 38 into the space 34 between manhole frame 10 and support ring 24. Preferably, upper rim 28*a* of collar 28 flares outwards towards flanges 27 so as to better serve to prevent concrete 38 from being forced beyond space 34 and extending into or falling into the manhole opening. Alternatively, a vertical annular collar 17 mounted around the inner surface of manhole frame 10 may be provided to maintain the appropriate distance between manhole frame 10 and support ring 24. Vertical annular collar 17 may also be flared outwards towards flanges 27 and base flange 18 to prevent concrete 38 from falling into the manhole opening.

With lower rim 28*b* of collar 28 seated within inner surface 12*b*, manhole frame 10 may be lowered down onto support ring 24 whereupon upper rim 28*a* assists in centering manhole frame 10 onto support ring 24 so as to bring the lower ends 14*a* of set screws 14 into mating engagement within a correspondingly sized groove 31 formed on the upper surface 27*a* of flanges 27. In the alternative embodiment where vertical collar 17 mounted around the inner surface of manhole frame 10 is provided instead of upper rim 28*a*, manhole frame 10 may be similarly lowered down onto support ring 24 whereupon vertical collar 17 assists in centering manhole frame 10 onto support ring 24 so as to bring the lower ends 14*a* of set screws 14 into mating engagement within a correspondingly sized groove 31 formed in the upper surface 27*a* of annular flange 27. In both embodiments, the lower ends 14*a* of set screws 14 may have blunt squared-off ends or bullet-shaped ends for snug mating into groove 31 such that lower ends 14*a* do not cut into the surface of groove 31. If the ends of the set screws do not bite into groove 31, for example as would happen with point-ended set screws, the possibility of the manhole frame 10 "walking out" of its preferred orientation as the set screws are turned is minimized. Alternatively, retaining means such as sleeves, collars, or nuts for threadably receiving or anchoring the lower ends of the set screws set screws 14 may be mounted on upper surface 27*a* of flanges 27 to correspondingly mate with lower ends of set screws 14.

Preferably, a flared rim 25*a* extends upwardly from the outer surface of at least one of the flanges 27 such that when manhole frame 10 is lowered onto support ring 24, flared rim 25*a* encompasses the outer circumference of base flange 18 to prevent any further movement of manhole frame 10 relative to spacer 12 so as to maintain the position of manhole frame 10 over manhole 32. Alternatively, outer rim 25*a* may extend downwardly from the outer circumference of annular flange 26 such that when support ring 24 is mounted on spacer ring 12, outer rim 25*a* may assist lower collar 28*b* in centering and maintaining the position of support ring 24 on spacer ring 12.

Advantageously, the apparatus according to the present invention meets the standard H20 load specification for highways and city streets even without the insertion of the concrete 38 into the space 34 between manhole frame 10 and support ring 24. In other words, when manhole frame 10 is adjustably mounted atop support ring 24 which is mounted atop annular concrete spacer ring 12 by the threading of threaded set screws 14 through threaded vertical bores 16 in the base flange 18, manhole frame 10 may support 40,000 pounds of weight even without the support of concrete 38. Preferably, concrete 38 is inserted in space 34 to provide additional support and to anchor spacer ring 12, support ring 24 and manhole frame 10. Concrete 38 also prevents ingress of water into the manhole.

Advantageously, the upper end of each set screw 14 is adapted to receive a common torqueing tool in mating engagement thereon. The upper ends of set screws 14 are adapted with female allen-key type apertures for mating engagement with T-handle allen-key tool. Thus with tool mated into the upper end of set screws 14 and set screws 14 threadably mounted into vertical bores 16, rotation of the tool in a first direction correspondingly rotates the set screw 14 to which it is mounted so as to adjust that set screw 14 in a second direction relative to flange 18. In this fashion, each set screw 14 may be independently adjusted so as to adjust both the vertical height of manhole frame 10 relative to spacer 12 and to adjust the angular inclination or tilt of manhole frame 10 relative to spacer 12, thereby allowing a single workman to adjust manhole frame 10, probably only once, and without the help of a second workman.

The use of set screws 14 mounted into threaded bores 16 also provides the opportunity for the use of mechanical assistance in lifting and placing a manhole frame 10 over spacer 12. For example, rigid eyes may be threadably mounted onto the exposed upper ends of set screws 14. A lifting harness, or chain or sling or the like may thus be attached to a pair of eyes mounted onto an oppositely disposed pair of set screws 14 to provide for the mechanical lifting of manhole frame 10 into place on top of support ring 24 and over spacer 12. Once manhole frame 10 has been placed onto support ring 24, a single workman may adjust the height and tilt of manhole frame 10 relative to spacer 12 by engaging the lower ends 14*a* of set screws 14 with groove 30 or retaining means mounted on annular flange 26 by using tool 20. The height and tilt of manhole frame 10 may thus be adjusted so as to bring the upper surface 10*a* of manhole frame 10 within the required tolerances generally flush with the anticipated upper surface of the roadway.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for adjusting the height and inclination of roadway and greenway appurtenances for mounting onto a rigid annular spacer ring sized so as to be mountable onto a manhole, the apparatus comprising:

a rigid annular support ring sized so as to be mountable onto the spacer ring;

a manhole frame having a vertical annular collar mounted around an inner surface of said manhole frame, said vertical collar extending downwards towards an inner surface of said annular support ring, said manhole frame mountable onto said support ring so as to sandwich said support ring between the spacer ring and said manhole frame;

a rigid annular base flange mounted around a base end of said manhole frame, a plurality of threaded bores formed in spaced array around said base flange, rigid elongate threaded members threadably mountable into said threaded bores so as to be selectively threadably adjustable in said threaded bores and so as to protrude downwardly from said base flange into engagement, beneath said manhole frame, with a top surface of said support ring when said manhole frame is mounted on said support ring, said threaded members threadably adjustable in said threaded bores to elevate or to tilt said manhole frame relative to said support ring.

2. The device of claim 1 wherein said plurality of threaded bores is at least three threaded bores in substantially equally radially spaced array around said base flange.

3. The device of claim 2 wherein said manhole frame is substantially frusto-conically shaped.

4. The device of claim 3 wherein said vertical collar flares outwards from said inner surface of said manhole frame towards said annular base flange.

5. The device of claim 4 further comprising includes an array of equally radially spaced apart flanges mounted so as to extend outwardly from said annular support ring for engaging said top surface of the spacer ring when said support ring is mounted thereon, said array of flanges aligning directly under said plurality of threaded bores when said manhole frame is mounted onto said support ring.

6. The device of claim 5 wherein a retaining means is mounted on each of said array of flanges for mating substantially conformably with lowermost ends of said treaded members.

7. The device of claim 6 wherein said retaining means includes a corresponding groove defined by a top surface of each of said array of flanges for mating with lowermost ends of said threaded members.

8. The device of claim 7 wherein lowermost ends of said threaded members are not concave.

9. The device of claim 8 wherein lowermost ends of said treaded members are bullet-shaped and each of said corresponding grooves mates substantially conformably with said lowermost ends.

10. The device of claim 9 wherein said rigid elongate threaded members are set screws made of a high strength alloy steel composition that is non-reactive with said manhole frame such that excessive rusting or seizing of said set screws is avoided.

11. The device of claim 10 wherein said support ring has a lower rim mounted to an inner circumference of said support ring for mating inside the spacer ring so as to centre said manhole frame above and over said base flange before said threaded members engage said array of flanges.

12. The device of claim 11 further comprising an outer rim mounted so as to extend upwardly from an outer surface of at least one of said array of flanges wherein when said manhole frame is mounted on said support ring, said rim encompasses said rigid annular base flange of said manhole frame so as to prevent any movement of said manhole frame relative to said support ring.

13. The device of claim 4 wherein said support ring includes an annular flange mounted so as to extend outwardly from said support ring for engaging said top surface of the spacer ring when said support ring is mounted thereon, said annular flange aligning wider said plurality of threaded bores when said manhole frame is mounted onto said support ring.

14. The device of claim 13 wherein a retaining means is mounted on said annular flange for mating substantially conformably with lowermost cads of said threaded members.

15. The device of claim 14 wherein said retaining means includes an annular groove defined on a top surface of said annular flange, said annular groove for mating with lowermost ends of said threaded members.

16. The device of claim 15 wherein lowermost ends of said threaded members are not concave.

17. The device of claim 16 wherein lowermost ends are bullet-shaped and said retaining means mate substantially conformably with said lowermost ends.

18. The device of claim 17 wherein said rigid elongate threaded members arc set screws made of a high strength alloy steel, composition that is non-reactive with said manhole frame such that excessive rusting or seizing of said set screws are avoided.

19. The device of claim 18 wherein said support ring has a lower rim for mating inside the spacer ring so as to space and centre said manhole frame above and over said base flange before said threaded members mate with said annular flange.

20. The device of claim 19 further comprising an outer annular rim mounted so as to extend upwardly from an outer circumference of said annular flange wherein when said manhole frame is mounted on said support ring, said rim encompasses said rigid annular base flange of said manhole frame so as to prevent any movement of said manhole frame relative to said support ring.

* * * * *